US012539002B1

(12) United States Patent
Sun

(10) Patent No.: US 12,539,002 B1
(45) Date of Patent: Feb. 3, 2026

(54) NON-SLIP BATH MAT

(71) Applicant: Junjie Sun, Dazhou (CN)

(72) Inventor: Junjie Sun, Dazhou (CN)

( * ) Notice: Subject to any disclaimer, the term of this patent is extended or adjusted under 35 U.S.C. 154(b) by 0 days.

(21) Appl. No.: 18/902,980

(22) Filed: Oct. 1, 2024

(51) Int. Cl.
*A47K 3/00* (2006.01)

(52) U.S. Cl.
CPC ..... *A47K 3/002* (2013.01)

(58) Field of Classification Search
CPC ..... A47K 3/001; A47K 3/002
See application file for complete search history.

(56) References Cited

U.S. PATENT DOCUMENTS 348,782 A * 9/1886 Sawyer ..... E04F 15/10 52/177
1,190,179 A * 7/1916 Livingston ..... A47K 3/002 D6/583
2,582,439 A * 1/1952 Kavanagh ..... A47K 3/12 4/575.1
5,216,764 A * 6/1993 Hall ..... A47K 3/001 4/244.3
5,742,955 A * 4/1998 Parkay ..... A47K 3/002 4/583
D414,973 S * 10/1999 Craft ..... D6/583
6,014,779 A * 1/2000 Lindholm ..... A47K 3/002 4/583
6,453,485 B2 * 9/2002 Bullock ..... A47K 3/002 4/DIG. 18
6,681,416 B1 * 1/2004 Yang ..... B29C 66/1122 4/581
7,454,807 B1 * 11/2008 Mardan ..... A61H 23/04 4/588
7,785,692 B1 * 8/2010 Siegel ..... A47G 27/0206 428/167

FOREIGN PATENT DOCUMENTS

GB 2247168 A * 2/1992 ..... A47K 3/002

* cited by examiner

*Primary Examiner* — Erin Deery
(74) *Attorney, Agent, or Firm* — Jose Cherson Weissbrot

(57) ABSTRACT

The invention relates to a non-slip bath mat (including an anti-slip foot mat and a bathtub mat), which comprises a mat body, on which a plurality of flexible protrusions are distributed, and closed airbag cavities are formed between the flexible protrusions and the mat body; when a person stands, sits or lies on the flexible protrusions with the airbag cavities, the flexible protrusions with the airbag cavities are connected under the human body, and the total ultimate bearing capacity of the flexible protrusions in the area is greater than the weight of a human being. The invention aims to improve the stability of the bathroom mat and facilitate cleaning and maintenance.

6 Claims, 4 Drawing Sheets

NON-SLIP BATH MAT

TECHNICAL FIELD

The invention relates to the technical field of daily necessities, in particular to a non-slip bath mat.

BACKGROUND ART

With the development of economy and the rising standard of living, in order to have a better bathing experience, a large number of ceramic tiles are laid in the bathrooms in modern times. Ceramic tiles can effectively avoid accumulating water and facilitate cleaning, and can also reflect the light for better bathroom environment. However, ceramic tiles will become smoother after being washed by water. In order to avoid injury, it is necessary to lay a bath mat in the bathroom to ensure comfort and protect the user.

In related technologies, the bath mat body is an integrated structure generally made of PVC and rubber flocking material. Non-slip grooves are arranged at intervals on the mat body, PVC, rubber flocking and other soft non-slip materials can effectively grab the floor to avoid slipping when the user steps on the mat body; at the same time, when the user steps on the mat body, the mat body will be deformed and wrapped around the feet of the user for better slip resistance. However, such materials are not degradable, their overall texture is hard, and it is difficult to automatically restore the mad body by relying on the elasticity of the material itself. The mat body will be deformed permanently when the user leaves the mat body, so that the mat body is easily damaged.

SUMMARY OF THE INVENTION

The main purpose of the invention is to provide a non-slip bath mat, which is designed to improve the stability of the bath mat, meet the international environmental requirements for material degradation and facilitate cleaning and maintenance.

To achieve the above purpose, the invention proposes a non-slip bath mat, which comprises a mat body, on which a plurality of flexible protrusions are distributed, and closed airbag cavities are formed between the flexible protrusions and the mat body; when a person stands, sits or lies on the flexible protrusions with the airbag cavities, the flexible protrusions with the airbag cavities are connected under the human body, and the total ultimate bearing capacity of the flexible protrusions in the area is greater than the weight of a human being.

In one embodiment of the application, the mat body is composed of one of EVA material and PEVA material or any combination thereof; The flexible protrusion is composed of one of EVA material and PEVA material or any combination thereof.

In one embodiment of the application, an easy lifting part which facilitates the mat body to be lifted from the floor is arranged on the edge of the mat body.

In one embodiment of the application, suction cups are arranged on the end face of the mat body deviating from the flexible protrusions.

In one embodiment of the application, a first contact surface is formed at the connection between the suction cup and the mat body, and a second contact surface is formed at the connection between the flexible protrusions and the mat body, and a projection surface of the first contact surface is located in the area of the second contact surface.

In one embodiment of the application, a plurality of suction cups are arranged evenly at intervals, each of which corresponds to one flexible protrusion.

In one embodiment of the application, the flexible protrusions are hemispherical, semielliptical, heart-shaped, polygonal or geometrical or in any combined shape thereof.

In the technical proposal of the invention, the mat body is arranged, has the basic non-slip effect and plays a role of connecting other structures, and a plurality of flexible protrusions are convexly arranged in an array on the mat body and are evenly spaced, making the user feel comfortable when stepping on, sitting on and lying on the flexible protrusions. The bath mat in the application has a variety of specifications, different specifications of bath mats can serve different users and have differences in area size of the mat body and size and interval of the flexible protrusions, and different sizes of flexible protrusions can produce different massage forces and have different pressure limits. In order to serve children, adults and fatter adults, different specifications of mat body are used, so that at least a plurality of flexible protrusions with airbag cavities are located beneath the body of the user when different service objects use the mats with different ultimate bearing capacities, thereby helping non-slip massage for the user and avoiding tripping the user due to excessively strong thrust resulting from too large flexible protrusions; the mat specifications adapt to users, the ultimate bearing capacity of the flexible protrusions in the area under the feet of the user is greater than the weight of the user, thereby avoiding the sudden rupture of the bath mat during use; at the same time, the protrusion is formed integrally with the mat body, and the materials used are fully mixed in the production process, so that the flexible protrusions have uniform texture and can withstand stronger pulling force to avoid deformation and damage; airbag cavities are arranged in the flexible protrusions, are completely sealed and can fully support the flexible protrusions to help the flexible protrusions recover to the original form after the stress disappears; moreover, gas in the airbag cavities make the flexible protrusions generate a massage force on the body and feet of the user when the user steps on the flexible protrusions, making the user more comfortable; in addition, the shape of the flexible protrusions is more stable when the flexible protrusions are provided with the airbag cavities; with uniform materials, the bath mat can effectively avoid rupture under stress, improving the user experience; at the same time, water cannot be accumulated in the flexible protrusions, water on the mat body can also be cleaned easily by a dry towel or directly hanging the bath mat, and the mat body can be kept clean conveniently; through the above structure, the stability of the bath mat can be effectively improved, and the bath mat is easily cleaned and maintained.

BRIEF DESCRIPTION OF THE DRAWINGS

In order to more clearly describe the technical proposal in the embodiment of the invention or the prior art, the drawings required to be used in the description of the embodiment or the prior art are briefly introduced below. Obviously, the drawings described below are only some embodiments of the invention. Ordinary technicians in the field may obtain other drawings based on the structures shown in these drawings without creative labor.

DESCRIPTION OF REFERENCE SIGNS FOR THE DRAWINGS

Figure 1:
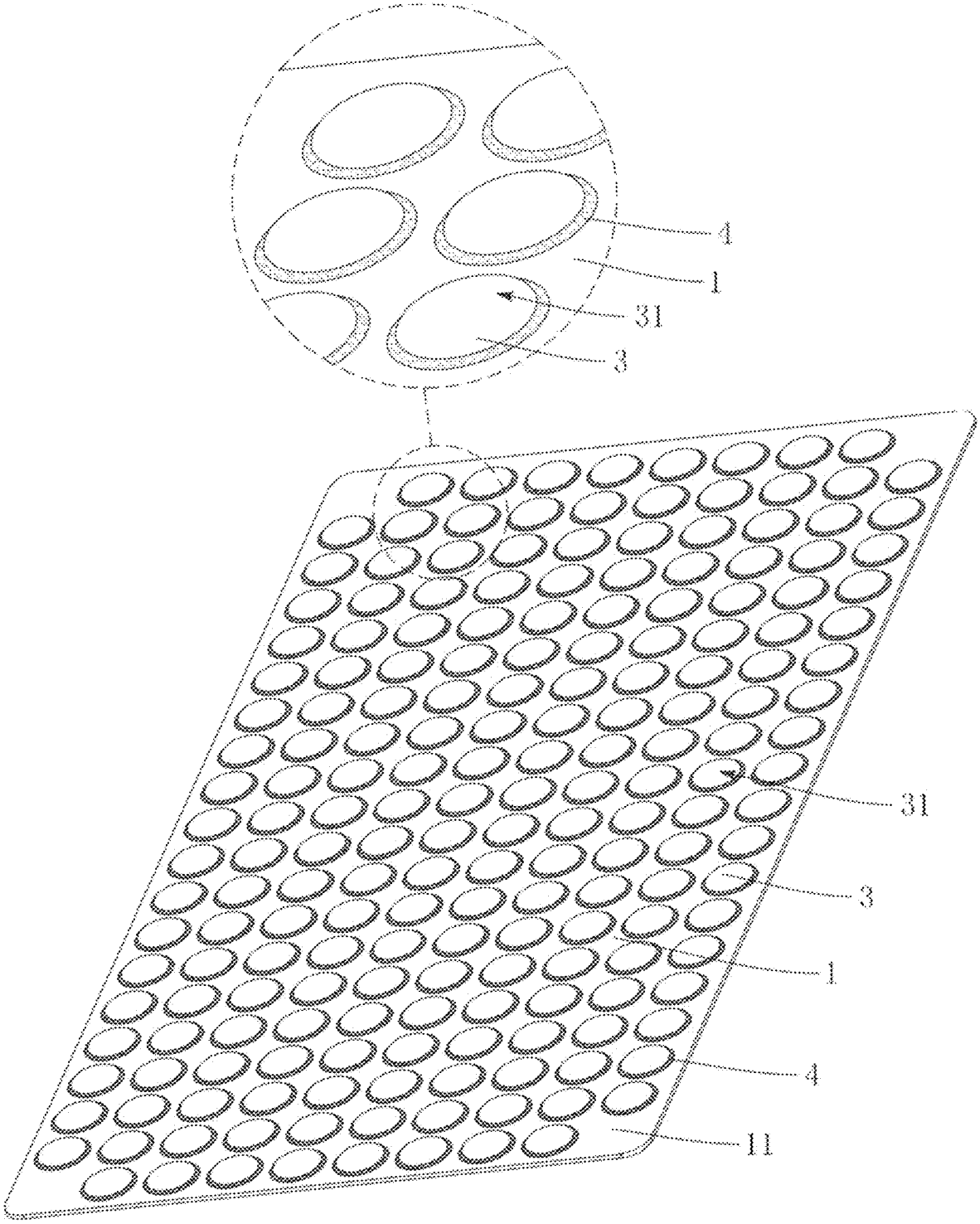
FIG. 1 is the structure diagram for the non-slip bath mat of the invention from one angle.

1. Mat body; 11. Easy lifting part; 2. Suction cup; 3. Flexible protrusion; 31. Airbag cavity; 4. Protective part.

The purpose realization, functional characteristics and advantages of the invention will be further explained in conjunction with the embodiments and with reference to the drawings.

DETAILED DESCRIPTION OF THE INVENTION

In order to make the purpose, technical proposal and advantages of the application clearer, the application is further described in detail in combination with the drawings and the embodiments. Understandably, the embodiments described herein are intended only to interpret the application, but not intended to limit the application.

As shown in FIG. 1 to FIG. 4, a non-slip bath mat proposed in one embodiment of the invention comprises a mat body 1, on which a plurality of flexible protrusions 3 are distributed, and closed airbag cavities 31 are formed between the flexible protrusions 3 and the mat body; when a person stands, sits or lies on the flexible protrusions 3 with the airbag cavities 31, the flexible protrusions 3 with the airbag cavities 31 are connected under the human body, and the total ultimate bearing capacity of the flexible protrusions 3 in the area is greater than the weight of a human being.

In a non-slip bath mat of the application, a mat body 1 is arranged, has the basic non-slip effect and plays a role of connecting other structures, and a plurality of groups of flexible protrusions 3 are convexly arranged in an array on the mat body 1 and are evenly spaced, making the user feel comfortable when stepping on the flexible protrusions 3. The bath mat in the application has a variety of specifications, different specifications of bath mats can serve different users and have differences in area size of the mat body 1 and size and interval of the flexible protrusions 3, and different sizes of flexible protrusions 3 can produce different massage forces and have different pressure limits. In order to serve children, adults and fatter adults, different specifications of mat body 1 are used, so that at least a plurality of flexible protrusions 3 with airbag cavities 31 are located beneath the body of the user when different service objects use the mats with different ultimate bearing capacities, thereby helping non-slip massage for the user and avoiding tripping the user due to excessively strong thrust resulting from too large flexible protrusions 3; the mat specifications adapt to users, the ultimate bearing capacity of the flexible protrusions 3 in the area under the feet of the user is greater than the weight of the user, thereby avoiding the sudden rupture of the bath mat during use; at the same time, the protrusion 3 is formed integrally with the mat body 1, and the materials used are fully mixed in the production process, so that the flexible protrusions 3 have uniform texture and can withstand stronger pulling force to avoid deformation and damage; airbag cavities 31 are arranged in the flexible protrusions 3, are completely sealed and can fully support the flexible protrusions 3 to help the flexible protrusions 3 recover to the original form after the stress disappears; moreover, gas in the airbag cavities 31 make the flexible protrusions 3 generate a massage force on the body and feet of the user when the user steps on, sits or lies on the flexible protrusions 3, making the user more comfortable; in addition, the shape of the flexible protrusions 3 is more stable when the flexible protrusions 3 are provided with the airbag cavities 31; with uniform materials, the bath mat can effectively avoid rupture under stress, improving the user experience; at the same time, water cannot be accumulated in the flexible protrusions 3, water on the mat body 1 can also be cleaned easily by a dry towel or directly hanging the bath mat, and the mat body 1 can be kept clean conveniently; the mechanical bearing capacity of the bath mat varies with the thickness, material and process of the mat body 1 and the flexible protrusions 3. In order to better serve different users such as children, adults and fat adults, the manufacturer can adjust the size of the flexible protrusions 3, the area of the mat body 1, the material of the bath mat and other parameters according to the actual target user objects; through the above structure, the stability of the bath mat can be effectively improved, and the bath mat is easily cleaned and maintained.

As shown in FIG. 1 to FIG. 4, in one embodiment of the application, the mat body 1 is composed of one of EVA material and PEVA material or any combination thereof; the flexible protrusion 3 is composed of one of EVA material and PEVA material or any combination thereof.

In a non-slip bath mat of the application, the mat body 1 is composed of one of EVA material and PEVA material or any combination thereof; the flexible protrusion 3 is composed of one of EVA material and PEVA material or any combination thereof. The mat body 1 can be formed integrally with the flexible protrusions 3, so that the bath mat itself is more uniform ensure the strength of the flexible protrusions 3 and avoid damage to the flexible protrusions 3 during the pressing process, and a circle of protective part 4 can be arranged on the mat body 1 relative to the flexible protrusions 3. In one feasible embodiment, the protective part 4 is convexly arranged on the mat body 1 and provided with an arc-shaped bevel relative to the mat body 1, the upper end of the protective part 4 is connected to the periphery of the flexible protrusions 3 to ensure the connection strength between the side of the flexible protrusions 3 and the mat body 1, and avoid damage to the flexible protrusions 3 under stress. Similarly, in another feasible embodiment, the protective part 4 is concavely arranged on the mat body 1, is a smooth downward bevel of the mat body 1 in the direction of the suction cups 2, and is provided with a smooth corner, the bottom edge of the protective part 4 covers the bottom wall of the flexible protrusions 3, the smooth corner can avoid damage to the flexible protrusions 3, and the protective part 4 can provide the flexible protrusions 3 with larger deformation space, thereby avoiding damage to the flexible protrusions 3 and ensuring the stability of the non-slip mat. The stable non-slip bath mat can be wiped directly with a soft dry towel to ensure the cleanliness of the mat and avoid polluting the bath mat easily in a humid environment. The use of the above materials can ensure the softness of the bath mat and improve the use experience; at the same time, the bath mat is easily degraded after damage and recycling, thereby reducing the environmental pollution.

As shown in FIG. 1, in one embodiment of the application, an easy lifting part 11 which facilitates the mat body 1 to be lifted from the floor is arranged on the edge of the mat body 1.

In a non-slip bath mat of the application, an easy lifting part 11 is arranged on the circumference of the mat body 1 relative to a plurality of groups of flexible protrusions 3, the flexible protrusions 3 are wrapped around the easy lifting part 11, the easy lifting part 11 is arranged at the periphery of the mat body 1, the general easy lifting part 11 is located at the four corners of the mat body 1, so that the user can easily pinch the easy lifting part 11 and uncover the mat body 1, facilitating recovery and transfer and avoiding damage to the flexible protrusions 3 when the user recovers the bath mat.

Figure 2:
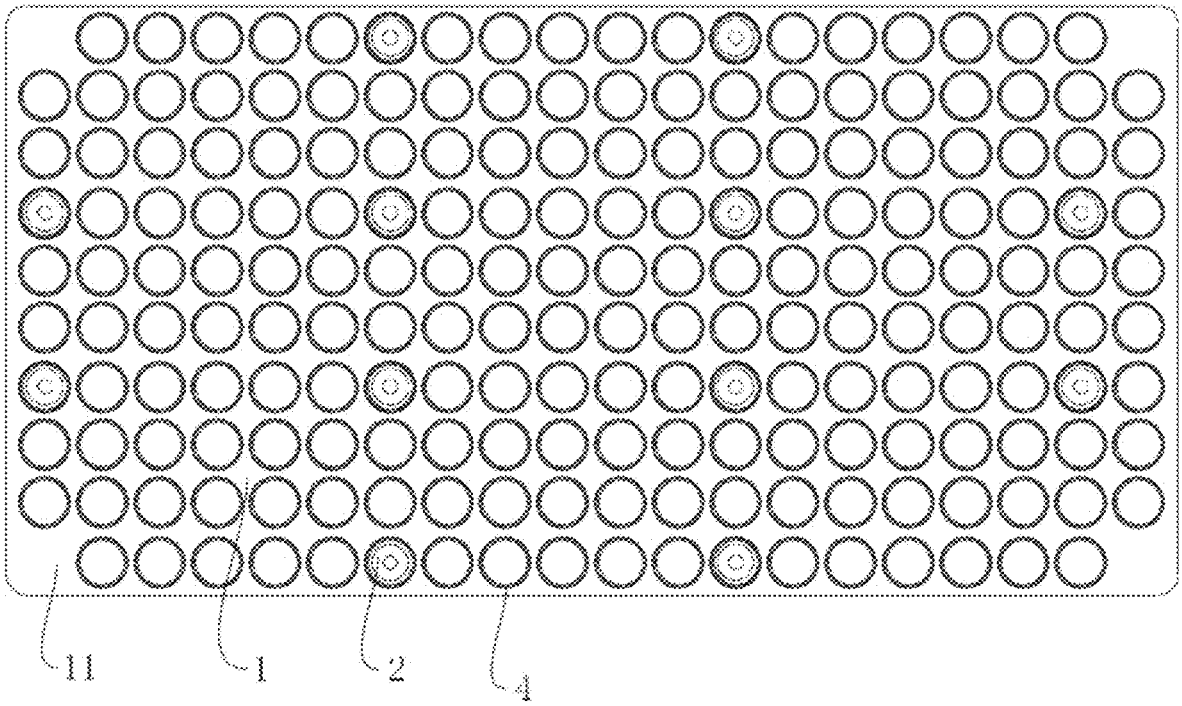
FIG. 2 is the structure diagram for the non-slip bath mat of the invention from another angle.
Figure 3:
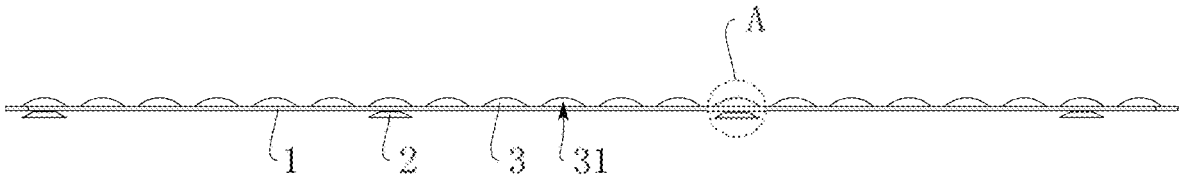
FIG. 3 is the structure diagram for the non-slip bath mat of the invention from another angle.
Figure 4:
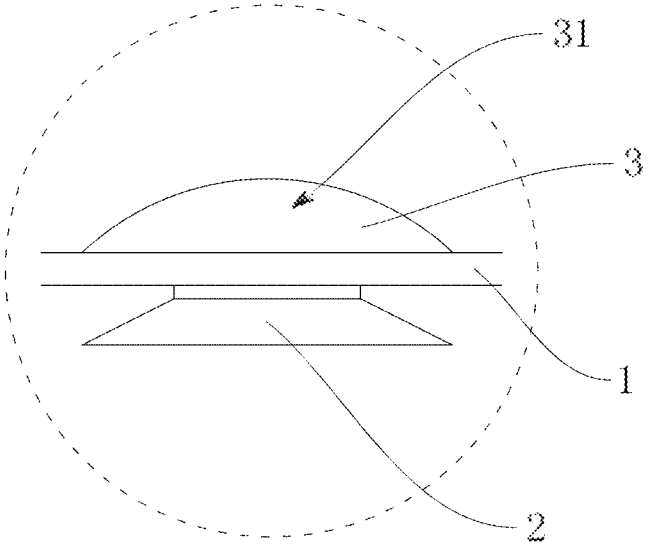
FIG. 4 is the enlarged view of FIG. 3 at point A.

As shown in FIG. 2 to FIG. 4, in one embodiment of the application, suction cups 2 are arranged on the end face of the mat body 1 deviating from the flexible protrusions 3.

In a non-slip bath mat of the application, the working environment of the bath mat is relatively humid, and the floor is generally composed of ceramic tiles, making the bath mat slipped on the floor. In order to ensure the installation stability of the bath mat and protect the safety of the user, a plurality of groups of suction cups 2 are arranged on the end face of the mat body 1 deviating from the flexible protrusions 3. In one feasible embodiment of the application, a plurality of groups of suction cups 2 are arranged and evenly connected to a plurality of groups of flexible protrusions 3 at intervals; the plurality of groups of suction cups 2 can increase the floor gripping force of the bath mat and ensure the installation stability of the bath mat; the plurality of groups of suction cups 2 are evenly spaced to distribute the force evenly to all parts of the mat body 1 when the bath mat is under stress, and the flexible protrusions 3 can be uniformly subjected to the pulling force brought by the mat body 1, thereby avoiding the deformation of the mat body 1 and the flexible protrusions 3 under stress, and improving the stability and service life of the bath mat.

As shown in FIG. 3 to FIG. 4, in one embodiment of the application, a first contact surface is formed at the connection between the suction cup 2 and the mat body 1, and a second contact surface is formed at the connection between the flexible protrusions 3 and the mat body 1, and a projection surface of the first contact surface is located in the area of the second contact surface.

In a non-slip bath mat of the application, the suction cups 2 are hard objects relative to the flexible protrusions 3, and users feel disconformable obviously when stepping on the position of the suction cups 2 corresponding to the mat body 1. In order to avoid discomfort when users step on the hard objects, a first contact surface is formed at the connection between the suction cup 2 and the mat body 1, and a second contact surface is formed at the connection between the flexible protrusions 3 and the mat body 1, and a projection surface of the first contact surface is located inside the second contact surface. When the user steps on the flexible protrusions 3, the flexible protrusions 3 are deformed and wrap the suction cups 2 completely, thereby reducing the discomfort caused when the user steps on the suction cups 2, producing a better massage effect, and effectively improving the user experience.

As shown in FIG. 1 to FIG. 4, in one embodiment of the application, a plurality of suction cups 2 are arranged evenly at intervals, each of which corresponds to one flexible protrusion 3.

In another feasible embodiment for a non-slip bath mat of the application, suction cups 2 and flexible protrusions 3 are arranged one to one, and each flexible protrusion 3 corresponds to a group of suction cups 2, so that the stress of the mat body 1 and the plurality of groups of flexible protrusions 3 is more stable; the stability of the bath mat can be effectively improved through the above structure, facilitating cleaning and maintenance.

As shown in FIG. 1, in one embodiment of the application, the flexible protrusions 3 are hemispherical, semielliptical, heart-shaped, polygonal or geometrical or in any combined shape thereof.

In a non-slip bath mat of the application, different shapes of flexible protrusions 3 can give users different massage feelings, and can be used to adjust the size of flexible protrusions 3 on the bath mat, the spacing between different flexible protrusions 3 and other parameters to adapt to different users. Flexible protrusions 3 can be hemispherical, semielliptical, heart-shaped, polygonal or geometrical or in any combined shape thereof. By adopting the above structure, the bath mat is easily produced and more beautiful.

Identical or similar signs in the drawings to the embodiment correspond to identical or similar components. Understandably, if the orientation or position relationships indicated by the terms such as "upper", "lower", "left" and "right" are based on the orientation or position relationships shown in the drawings, they are only used for the purpose of facilitating the description of the application and simplifying the description, but not used for indicating or implying that the device or element referred to must have a particular orientation, be constructed and operated in a particular orientation. Therefore, the terms used to describe the location relationships in the drawings are for illustrative purposes only and cannot be construed as a limitation to the patent. Ordinary technicians in the field may understand the specific meanings of the above terms as the case may be.

The above embodiment is only the preferred embodiment of the application and is not intended to limit the application. Any modification, equivalent substitution, improvement, etc. made within the spirit and principles of the application should fall with the scope of protection of application.

The invention claimed is:

1. A non-slip bath mat, having a non-slip effect when a person sits, lies or stands, comprising:

a mat body, wherein the mat body includes an upper surface and a lower surface, a plurality of flexible protrusions are convexly arranged in an array over the upper surface of the mat body, and a protective part is arranged around a circumference of either of a convex side or a concave side of each of the plurality of flexible protrusions;

wherein when arranged on the convex side, the protective part includes an arc shaped bevel relative to the mat body; and wherein when arranged on the concave side, the protective part includes a downward bevel relative to the mat body in direction of a plurality of suction cups, a corner, and a bottom edge of the protective part covers a bottom wall of the plurality of flexible protrusions;

the plurality of suction cups are distributed on the lower surface of the mat body;

a projection surface of each suction cup is located in an area of the lower surface;

closed airbag cavities are formed between the flexible protrusions and the mat body;

and wherein when the person stands, sits or lies on the flexible protrusions with the airbag cavities, the flexible protrusions with the airbag cavities are connected under the person, and the total bearing capacity of the flexible protrusions is greater than the weight of the person.

2. The non-slip bath mat in claim 1, wherein the mat body is composed of one of EVA material and PEVA material or any combination thereof:

the flexible protrusion is composed of one of EVA material and PEVA material or any combination thereof.

3. The non-slip bath mat in claim 1, wherein a lifting part which facilitates the mat body to be lifted from the floor is arranged on the edge of the mat body.

4. The non-slip bath mat in claim 1, wherein the plurality of suction cups are arranged on the end face of the mat body deviating from the flexible protrusions.

5. The non-slip bath mat in claim 4, wherein the plurality of suction cups are arranged evenly at intervals, each of which corresponds to one flexible protrusion.

6. The non-slip bath mat in claim 4, wherein the flexible protrusions are hemispherical, semielliptical, heart-shaped, polygonal or geometrical or in any combined shape thereof.

* * * * *